US010054880B2

(12) United States Patent
Tamaki et al.

(10) Patent No.: US 10,054,880 B2
(45) Date of Patent: Aug. 21, 2018

(54) APPARATUS HAVING A CONTROL UNIT FOR OPERATING HALOGEN LAMP HEATERS BASED ON DUTY CYCLE

(71) Applicant: Konica Minolta, Inc., Chiyoda-ku, Tokyo (JP)

(72) Inventors: Kenji Tamaki, Tokorozawa (JP); Teruhiko Toyoizumi, Tachikawa (JP); Tadashi Matsudaira, Hachioji (JP); Hirofumi Nakajima, Hino (JP); Tatsuo Ishizuka, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/410,809

(22) Filed: Jan. 20, 2017

(65) Prior Publication Data

US 2017/0219968 A1 Aug. 3, 2017

(30) Foreign Application Priority Data

Feb. 3, 2016 (JP) ..... 2016-018556

(51) Int. Cl.
*G03G 15/20* (2006.01)

(52) U.S. Cl.
CPC ..... *G03G 15/2007* (2013.01); *G03G 15/2039* (2013.01); *G03G 2215/0135* (2013.01)

(58) Field of Classification Search
USPC ..... 399/69, 328
See application file for complete search history.

(56) References Cited

U.S. PATENT DOCUMENTS 8,835,815 B2 * 9/2014 Kasai ..... H05B 1/0241 219/216
2010/0239301 A1 * 9/2010 Nemoto ..... G03G 15/2039 399/69
2014/0133880 A1 * 5/2014 Otsuka ..... G03G 15/2078 399/70

FOREIGN PATENT DOCUMENTS

JP 2011257604 A 12/2011

* cited by examiner

*Primary Examiner* — Quana M Grainger
(74) *Attorney, Agent, or Firm* — Buchanan Ingersoll & Rooney PC

(57) ABSTRACT

An image forming apparatus includes halogen lamp heaters, an AC power supply, a temperature detection unit and a control unit. The heaters have a same light distribution and heat a fixing member of an image fixing unit. The detection unit detects a temperature of the fixing member. The control unit determines a combination of the heaters based on output of the detection unit and applies a drive voltage of a half-wave of an AC waveform of the AC power supply to a heater of the heaters. The half-wave is selected based on an application pattern having a duty cycle of a predetermined value or more. The heaters include at least one heater which generates a heat amount being a minimum heat amount required for fixing or less when turned on with the application pattern having the duty cycle of the predetermined value.

8 Claims, 11 Drawing Sheets

FIG.9

| 700W+1100W | | | |
|---|---|---|---|
| HEATER TO TURN ON | TOTAL POWER(W) | RESOLUTION(W) | DUTY CYCLE(%) |
| 700W | 280 | | 40 |
| | 327 | 47 | 46 |
| | 373 | 47 | 53 |
| | 420 | 47 | 60 |
| | 467 | 47 | 66 |
| | 513 | 47 | 73 |
| | 560 | 47 | 80 |
| | 607 | 47 | 86 |
| | 653 | 47 | 93 |
| 1100W | 733 | 80 | 66 |
| | 807 | 73 | 73 |
| | 880 | 73 | 80 |
| | 953 | 73 | 86 |
| | 1027 | 73 | 93 |
| | 1100 | 73 | 100 |
| 700W(ON) + 1100W | 1140 | 40 | 40 |
| | 1213 | 73 | 46 |
| | 1287 | 73 | 53 |
| | 1360 | 73 | 63 |
| | 1433 | 73 | 66 |
| | 1507 | 73 | 73 |
| | 1580 | 73 | 80 |
| | 1653 | 73 | 86 |
| | 1727 | 73 | 93 |
| | 1800 | 73 | 100 |

FIG.10

| 600W+1200W | | | |
|---|---|---|---|
| HEATER TO TURN ON | TOTAL POWER(W) | RESOLUTION(W) | DUTY CYCLE(%) |
| 600W | 240 | | 40 |
| | 280 | 40 | 46 |
| | 320 | 40 | 53 |
| | 360 | 40 | 63 |
| | 400 | 40 | 66 |
| | 440 | 40 | 73 |
| | 480 | 40 | 80 |
| | 520 | 40 | 86 |
| | 560 | 40 | 93 |
| | 600 | 40 | 66 |
| 1200W | 640 | 40 | 73 |
| | 720 | 80 | 80 |
| | 800 | 80 | 86 |
| | 880 | 80 | 93 |
| | 960 | 80 | 100 |
| | 1040 | 80 | 40 |
| | 1120 | 80 | 46 |
| | 1200 | 80 | 53 |
| 600W(ON) + 1200W | 1320 | 80 | 63 |
| | 1400 | 120 | 66 |
| | 1480 | 80 | 73 |
| | 1560 | 80 | 80 |
| | 1640 | 80 | 86 |
| | 1720 | 80 | 93 |
| | 1800 | 80 | 100 |

FIG.11

| 500W+1300W | | | |
|---|---|---|---|
| HEATER TO TURN ON | TOTAL POWER(W) | RESOLUTION(W) | DUTY CYCLE(%) |
| 500W | 200 | | 40 |
| | 233 | 33 | 46 |
| | 267 | 33 | 53 |
| | 300 | 33 | 60 |
| | 333 | 33 | 66 |
| | 367 | 33 | 73 |
| | 400 | 33 | 80 |
| | 433 | 33 | 86 |
| | 467 | 33 | 93 |
| | 500 | 33 | 100 |
| 1300W | 607 | 107 | 46 |
| | 693 | 87 | 53 |
| | 780 | 87 | 60 |
| | 867 | 87 | 66 |
| | 953 | 87 | 73 |
| | 1040 | 87 | 80 |
| | 1127 | 87 | 86 |
| | 1213 | 87 | 93 |
| | 1300 | 87 | 100 |
| 500W(ON) + 1300W | 1367 | 67 | 66 |
| | 1453 | 87 | 73 |
| | 1540 | 87 | 80 |
| | 1627 | 87 | 86 |
| | 1713 | 87 | 93 |
| | 1800 | 87 | 100 |

FIG.12

| 600W×3 | | | |
|---|---|---|---|
| HEATER TO TURN ON | TOTAL POWER(W) | RESOLUTION(W) | DUTY CYCLE(%) |
| 600W | 240 | | 40 |
| | 280 | 40 | 46 |
| | 320 | 40 | 53 |
| | 360 | 40 | 60 |
| | 400 | 40 | 66 |
| | 440 | 40 | 73 |
| | 480 | 40 | 80 |
| | 520 | 40 | 86 |
| | 560 | 40 | 93 |
| | 600 | 40 | 100 |
| 600W(ON) + 600W | 840 | 240 | 40 |
| | 880 | 40 | 46 |
| | 920 | 40 | 53 |
| | 960 | 40 | 60 |
| | 1000 | 40 | 66 |
| | 1040 | 40 | 73 |
| | 1080 | 40 | 80 |
| | 1120 | 40 | 86 |
| | 1160 | 40 | 93 |
| | 1200 | 40 | 100 |
| 600W×2(ON) + 600W | 1440 | 240 | 40 |
| | 1480 | 40 | 46 |
| | 1520 | 40 | 53 |
| | 1560 | 40 | 60 |
| | 1600 | 40 | 66 |
| | 1640 | 40 | 73 |
| | 1680 | 40 | 80 |
| | 1720 | 40 | 86 |
| | 1760 | 40 | 93 |
| | 1800 | 40 | 100 |

APPARATUS HAVING A CONTROL UNIT FOR OPERATING HALOGEN LAMP HEATERS BASED ON DUTY CYCLE

CROSS-REFERENCE TO RELATED APPLICATIONS

This application claims a priority under the Paris Convention of Japanese Patent Application No. 2016-018556 filed on Feb. 3, 2016, the entire disclosure of which, including the specification, claims, drawings and abstract, is incorporated herein by reference in its entirety.

BACKGROUND OF THE INVENTION

1. Field of the Invention

The present invention relates to an image forming apparatus.

2. Description of the Related Art

In fixing control of an image forming apparatus, typically, a halogen lamp heater is used as a fixing heater, and temperature of the fixing heater is controlled by ON/OFF control. In order to control the temperature more finely, there is a control method of supplying drive voltage of appropriately selected half-waves of AC waveform to a halogen lamp heater.

In this kind of control method, the number of half-waves of the AC waveform in a predetermined period (duty cycle) is appropriately selected according to the heat amount to be required, and the effective value of drive voltage to be supplied to a halogen lamp heater changes according to the selected number of half-waves of the AC waveform.

Meanwhile, for a halogen lamp heater, there is a reference voltage with which halogen cycle occurs most efficiently. If the number of selected half-waves (i.e., the selected number of half-waves) of the AC waveform is small, and hence the effective value of drive voltage to be supplied to a halogen lamp heater is smaller than the reference voltage, the temperature of a filament (tungsten) of the halogen lamp heater becomes low, and a phenomenon that the filament is eaten away, called "chemical attack", occurs.

Then, there is a heater control device (Japanese Patent Application Publication No. 2011-257604) which, in order to let halogen cycle occur in the standby mode too, fully turns on (ON) a halogen lamp heater at predetermined time intervals, and when a filament thereof reaches a predetermined temperature, supplies drive voltage of appropriately selected half-waves of the AC waveform to the halogen lamp heater without turning off (OFF) the halogen lamp heater, thereby reducing flicker as well as preventing breaking of the filament.

The heat amount required for image forming depends on the type and/or the thickness of paper, which is a recording medium. For example, in the case of image forming on thin paper, the required heat amount is small, and therefore the application pattern for drive voltage has a small number of half-waves of the AC waveform selected in a predetermined period (low duty cycle). In this case, the duty cycle of the application pattern is limited to a predetermined value or more, which can prevent chemical attack and extend life of the halogen lamp heater.

However, even if, in order to prevent chemical attack, the duty cycle of the application pattern is limited to the predetermined value or more in the case of image forming on thin paper, the heater cannot be kept ON if the heat amount generated by turning on the heater with the application pattern having the duty cycle is more than the required heat amount, and needs to be turned off at appropriate timing to make the heat amount close to the required heat amount. Such temperature control cannot stabilize the temperature of a fixing roller.

BRIEF SUMMARY OF THE INVENTION

The present invention has been conceived in view of the above circumstances, and objects of the present invention include providing an image forming apparatus which can extend lives of halogen lamp heaters and also can stabilize temperature of a fixing roller.

In order to achieve the above or other objects, according to an aspect of the present invention, there is provided an image forming apparatus including: a plurality of halogen lamp heaters which have a same light distribution and heat a fixing member of an image fixing unit; an AC power supply; a temperature detection unit which detects a temperature of the fixing member; and a control unit which determines a combination of the halogen lamp heaters based on output of the temperature detection unit, and applies a drive voltage of a half-wave of an AC waveform of the AC power supply to a halogen lamp heater of the halogen lamp heaters, the half-wave being selected based on an application pattern having a duty cycle of a predetermined value or more, wherein the halogen lamp heaters include at least one halogen lamp heater which generates a heat amount being a minimum heat amount required for fixing or less when turned on with the application pattern having the duty cycle of the predetermined value.

Preferably, the image forming apparatus further includes a table in which the combination of the halogen lamp heaters and the duty cycle of the predetermined value or more are set forth, wherein the control unit calculates a required heat amount based on the output of the temperature detection unit, and selects the combination of the halogen lamp heaters and the duty cycle which satisfy the required heat amount.

Preferably, in the image forming apparatus, the control unit applies the drive voltage to one of the halogen lamp heaters and fully turns on a rest of the halogen lamp heaters.

Preferably, in the image forming apparatus, the halogen lamp heaters include: a first halogen lamp heater; and a second halogen lamp heater which generates a less heat amount than the first halogen lamp heater, and the second halogen lamp heater generates a heat amount being the minimum heat amount required for fixing or less when turned on with the application pattern having the duty cycle of the predetermined value.

Preferably, in the image forming apparatus, the halogen lamp heaters include: a first halogen lamp heater; and a second halogen lamp heater which generates a less heat amount than the first halogen lamp heater, and the control unit applies the drive voltage to the second halogen lamp heater when a heat amount required for fixing is equal to or less than the heat amount of the second halogen lamp heater.

Preferably, in the image forming apparatus, the halogen lamp heaters include: a first halogen lamp heater; and a second halogen lamp heater which generates a less heat amount than the first halogen lamp heater, and the control unit applies the drive voltage to the first halogen lamp heater when a heat amount required for fixing is more than the heat amount of the second halogen lamp heater and equal to or less than a heat amount of the first halogen lamp heater.

Preferably, in the image forming apparatus, the halogen lamp heaters include: a first halogen lamp heater; and a second halogen lamp heater which generates a less heat amount than the first halogen lamp heater, and the control unit applies the drive voltage to the first halogen lamp heater and fully turns on the second halogen lamp heater when a heat amount required for fixing is more than a heat amount of the first halogen lamp heater.

Preferably, in the image forming apparatus, a heat amount generated by any of the halogen lamp heaters turned on with the application pattern having the duty cycle of the predetermined value is a heat amount required to prevent breaking of a filament of any of the halogen lamp heaters.

BRIEF DESCRIPTION OF THE SEVERAL VIEWS OF THE DRAWING

The present invention is fully understood from the detailed description given hereinafter and the accompanying drawings, which are given by way of illustration only and thus are not intended to limit the present invention, wherein:

FIG. 9 shows a table as an example;

FIG. 10 shows a table as another example;

FIG. 11 shows a table as another example; and

FIG. 12 shows a table as an example for the case of combination of three halogen lamp heaters.

DETAILED DESCRIPTION OF THE INVENTION

Embodiment

[1. Explanation of Configuration]

Hereinafter, an image forming apparatus according to an embodiment of the present invention is described with reference to the drawings.

Figure 1:
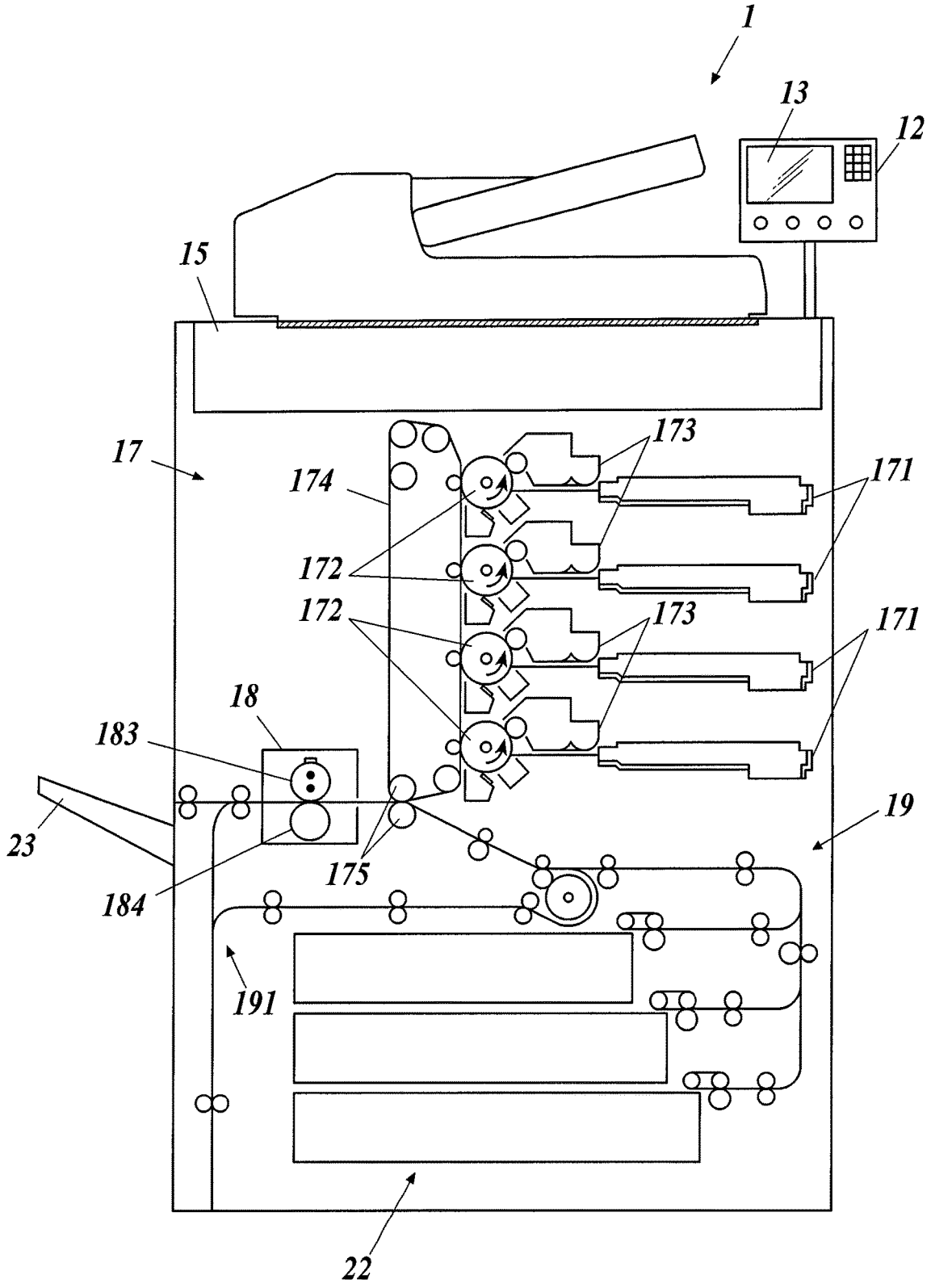
FIG. 1 shows the schematic configuration of an image forming apparatus according to an embodiment of the present invention.
Figure 2:
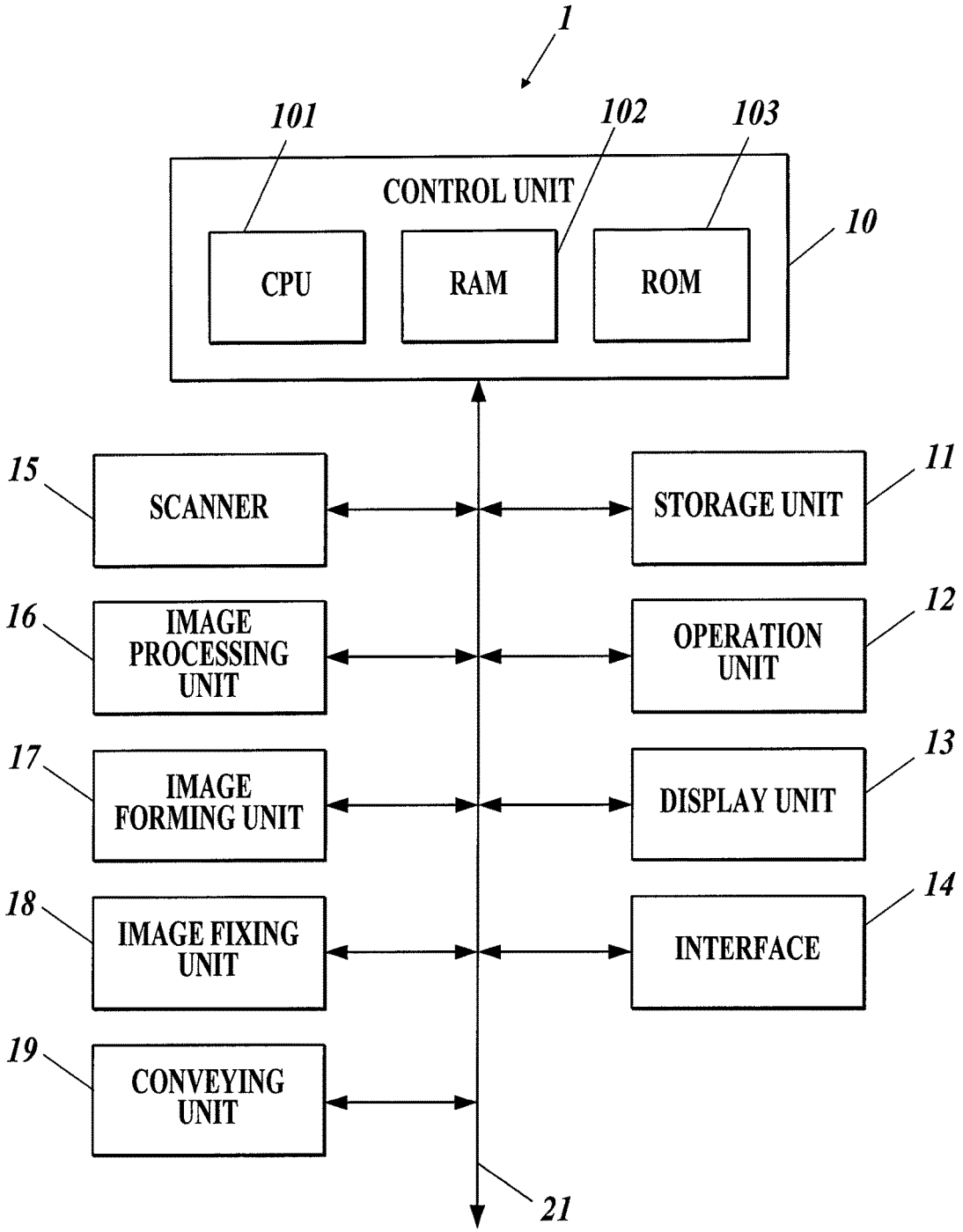
FIG. 2 is a block diagram showing the main functional components of the image forming apparatus.

FIG. 1 shows the schematic configuration of an image forming apparatus 1, which is an embodiment of the present invention. FIG. 2 is a block diagram showing the main functional components of the image forming apparatus 1.

The image forming apparatus 1 includes: a control unit 10 having a CPU 101 (Central Processing Unit), a RAM 102 (Random Access Memory) and a ROM 103 (Read Only Memory); a storage unit 11; an operation unit 12; a display unit 13; an interface 14; a scanner 15; an image processing unit 16; an image forming unit 17; an image fixing unit 18; and a conveying unit 19. The control unit 10 is connected to the storage unit 11, the operation unit 12, the display unit 13, the interface 14, the scanner 15, the image processing unit 16, the image forming unit 17, the image fixing unit 18 and the conveying unit 19 via a bus 21.

The CPU 101 reads and executes various control programs stored in the ROM 103 or the storage unit 11, thereby performing various types of arithmetic processing.

The RAM 102 offers a working memory space to the CPU 101 and temporarily stores data.

The ROM 103 stores the various control programs, which are executed by the CPU 101, setting data and so forth. Instead of the ROM 103, a rewritable nonvolatile memory, such as an EEPROM (Electrically Erasable Programmable Read Only Memory) or a flash memory, may be used.

The control unit 10, which has the CPU 101, the RAM 102 and the ROM 103, controls all the units or the like of the image forming apparatus 1 in accordance with the above various control programs. For example, the control unit 10 causes the image processing unit 16 to perform predetermined image processing on image data and the storage unit 11 to store the processed image data. Further, the control unit 10 causes the conveying unit 19 to convey paper and the image forming unit 17 to form images on the paper based on the image data stored in the storage unit 11.

The storage unit 11 is constituted of a DRAM (Dynamic Random Access Memory), which is a semiconductor memory, and/or an HDD (Hard Disk Drive), and stores image data obtained by the scanner 15, image data input from the outside via the interface 14, and so forth. These image data and so forth may be stored in the RAM 102.

The operation unit 12 includes an input device, such as operation keys and/or a touch panel disposed on the screen of the display unit 13, and converts input operations to the input device into operation signals, and outputs the operation signals to the control unit 10.

The display unit 13 includes a display device, such as an LCD (Liquid Crystal Display), and displays status of the image forming apparatus 1, operation screens showing contents of the input operations to the touch panel, and so forth.

The interface 14 sends/receives data to/from external computers, other image forming apparatuses and so forth, and constituted of any one of various serial interfaces.

The scanner 15 reads images formed on paper, generates image data containing single-color image data of color components of R (red), G (green) and B (blue), and stores the generated image data in the storage unit 11.

The image processing unit 16 includes a rasterization unit, a color conversion unit, a gradation correction unit and a halftoning unit, and performs various types of image processing on the image data stored in the storage unit 11, and stores the processed image data in the storage unit 11.

The image forming unit 17 forms images on paper based on the image data stored in the storage unit 11. The image forming unit 17 includes four image forming sections for respective color components of C (cyan), M (magenta), Y (yellow) and K (black). Each image forming section includes an exposure unit 171, a photoreceptor 172 and a development unit 173. The image forming unit 17 also includes a transfer body 174 and a pair of secondary transfer rollers 175.

The exposure unit 171 includes an LD (Laser Diode) as a light emitting element. The exposure unit 171 drives the LD on the basis of image data, and irradiates and exposes the charged photoreceptor 172 with and to laser light, thereby forming an electrostatic latent image on the photoreceptor 172. The development unit 173 supplies a toner (color material) of a predetermined color (C, M, Y or K) onto the exposed photoreceptor 172 with a charged roller, thereby developing the electrostatic latent image formed on the photoreceptor 172.

The images respectively composed of the C, M, Y and K toners (single-color images) on the four photoreceptors 172 respectively for C, M, Y and K are successively transferred from the respective photoreceptors 172 to the transfer body 174 to be superposed on top of one another, thereby forming a multi-color image composed of C, M, Y and K color components on the transfer body 174. The transfer body 174 is an endless belt wounded around transfer-body conveying rollers and rotates as the transfer-body conveying rollers rotate.

The pair of secondary transfer rollers 175 transfers the multi-color image on the transfer body 174 to paper fed from a paper feed tray 22 or an external paper feeding device. To be specific, a predetermined transfer voltage is applied to the secondary transfer rollers 175 sandwiching the paper and the transfer body 174, which attracts the toners of the multi-color image on the transfer body 174 to the paper side and thus transfers the multi-color image to the paper.

The image fixing unit 18 heats and presses the paper, to which the toners have been transferred, thereby fixing the toners to the paper, namely, performing fixing.

Figure 3:
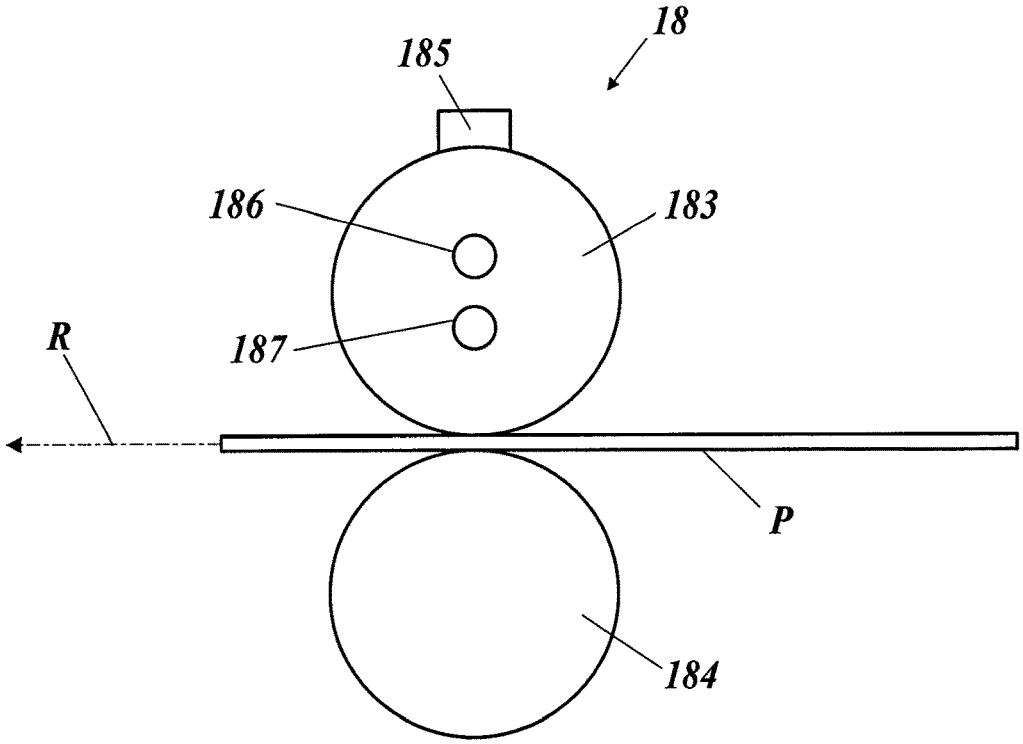
FIG. 3 is a schematic view showing the configuration of an image fixing unit.

FIG. 3 is a schematic view showing the configuration of the image fixing unit 18. The image fixing unit 18 includes a fixing roller 183, a pressure roller 184 and a temperature detection unit 185. The image forming unit 18 and the control unit 10 constitute a fixing device.

The fixing roller 183 includes halogen lamp heaters 186 and 187 each of which is a fixing lamp (or fixing heater) extending in the rotation axis direction. The halogen lamp heaters 186 and 187 generate heat by being electrified under the control of the control unit 10. The fixing roller 183 rotates by being driven by a not-shown rotary drive unit, such as a motor, under the control of the control unit 10. The fixing roller 183 is provided with the temperature detection unit 185 which detects temperature of the fixing roller 183. As long as the temperature of the fixing roller 183 can be detected, the number of temperature detection units 185 to be provided is not limited to one and may be two or more.

Figure 4:
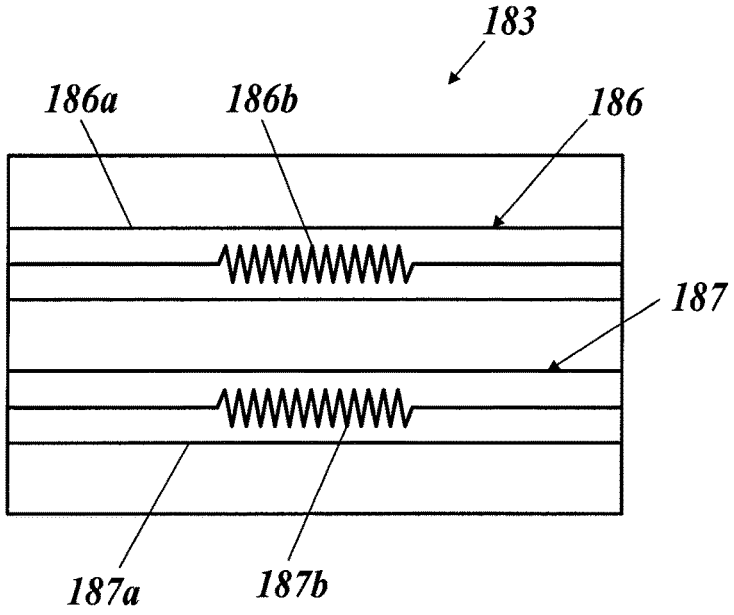
FIG. 4 is a schematic view showing the internal configuration of a fixing roller.

FIG. 4 is a schematic view showing the internal configuration of the fixing roller 183.

The halogen lamp heaters 186 and 187 are respectively constituted of tungsten filaments 186*b* and 187*b* in their respective cylindrical parts 186*a* and 187*a*. Each of the cylindrical parts 186*a* and 187*a* is filled with a halogen gas of a predetermined concentration. Based on the concentration of the halogen gas with which each of the cylindrical parts 186*a* and 187*a* is filled, the reference voltage is set for each of the halogen lamp heaters 186 and 187.

The halogen lamp heaters 186 and 187 are halogen lamp heaters of the same light distribution, and the filaments 186*b* and 187*b* are configured to heat the middle portion in the axis direction of the fixing roller 183 (middle-portion light distribution).

As a matter of course, the fixing roller 183 may have, in addition to the halogen lamp heaters 186 and 187, a halogen lamp heater(s) of whole-area light distribution, which heats the whole area in the axis direction of the fixing roller 183, and/or a halogen lamp heater(s) of end-portion light distribution, which heats the end portions in the axis direction of the fixing roller 183.

As shown in FIG. 3, the pressure roller 184 is biased in a direction to approach the fixing roller 183 by an elastic member (not shown), thereby contacting the fixing roller 183 by pressure, and rotates as the fixing roller 183 rotates while forming a fixing nip with the fixing roller 183.

The pressure roller 184 may rotate by being driven by a not-shown rotary drive unit, such as a motor, under the control of the control unit 10.

The fixing roller 183 and the pressure roller 184 heat and press paper P as a recording medium while sandwiching the paper P at the fixing nip and conveying the paper P in a conveying direction R indicated by an arrow in FIG. 3. Thus, the fixing roller 183 and the pressure roller 184 melt and fix toners on the paper P. Temperature of the fixing roller 183 when the fixing roller 183 contacts the paper P should be, for example, within a range from 180° C. to 200° C. inclusive. Hence, the halogen lamp heaters 186 and 187 heat the fixing roller 183 such that the temperature of the fixing roller 183 becomes within the range.

As shown in FIG. 1, the conveying unit 19 includes pairs of paper-conveying rollers which convey paper by rotating in the state of sandwiching the paper, and conveys paper along a predetermined conveying path. The conveying unit 19 also includes a reversing mechanism 191 which reverses paper having been subjected to fixing of the image fixing unit 18 and conveys the paper to the secondary transfer rollers 175. In the image forming apparatus 1, in the case of double-side image-forming, paper is ejected to a paper receiving tray 23 after being reversed by the reversing mechanism 191, thereby having images on both sides of the paper, whereas in the case of single-side image-forming, paper is ejected to the paper receiving tray 23 without being reversed by the reversing mechanism 191, thereby having an image(s) on one side of the paper.

[2. Explanation of Control Circuit of Image Fixing Unit]

Figure 5:
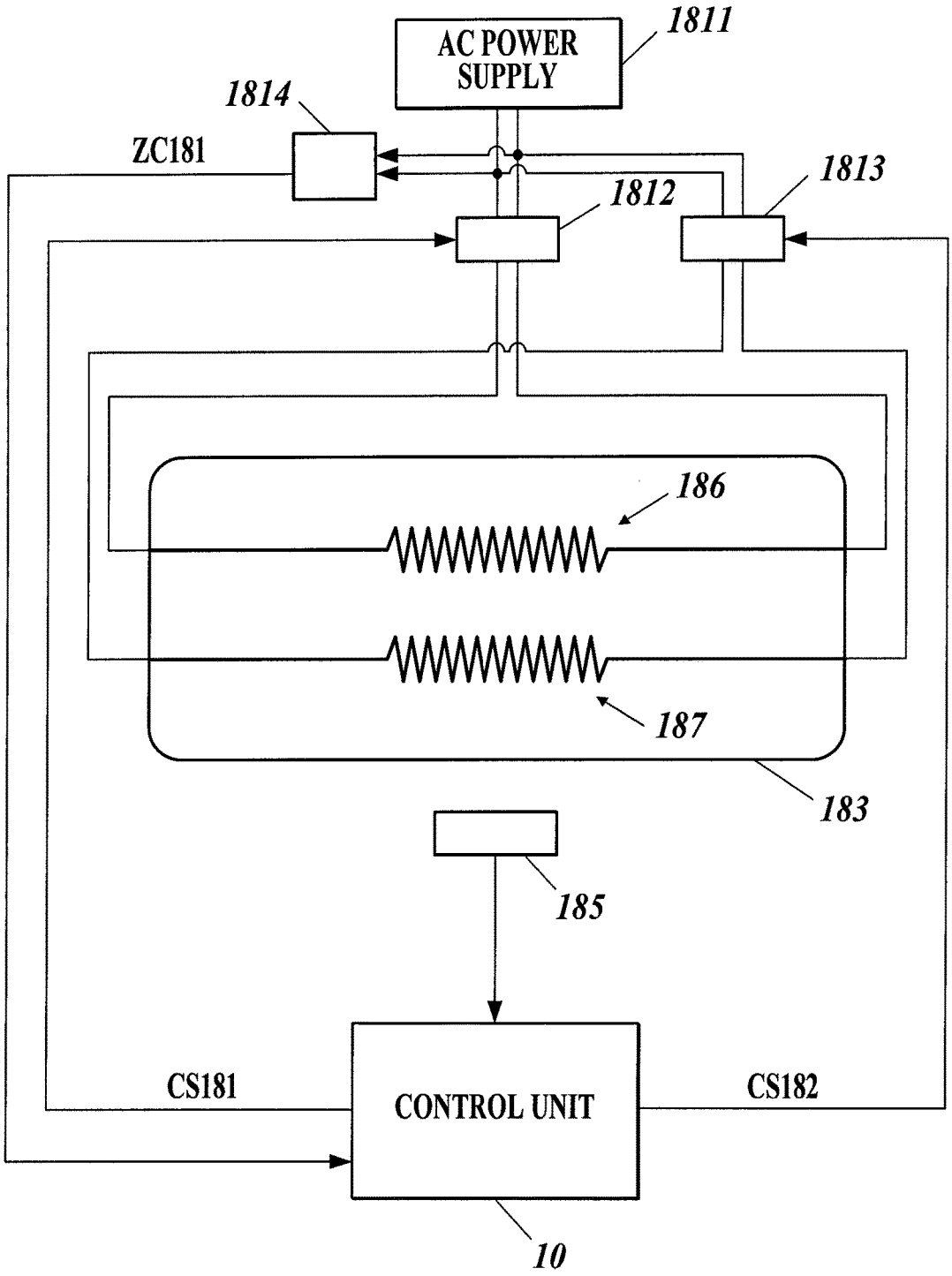
FIG. 5 is a control circuit diagram of the image fixing unit.

An AC power supply 1811 in FIG. 5 outputs normal AC voltage (e.g., 100 V or 200 V and 50 Hz or 60 Hz).

Each of switching elements 1812 and 1813 is a thyristor, a bidirectional thyristor (TRIAC) or the like, and becomes "ON" and conducts electricity when a trigger signal is applied to the gate as a control terminal. Output of the AC power supply 1811 is connected to input terminals of the switching elements 1812 and 1813, and output terminals of the switching elements 1812 and 1813 are respectively connected to the input terminals of the halogen lamp heaters 186 and 187.

The control unit 10 performs temperature control on the halogen lamp heaters 186 and 187. More specifically, the control unit 10 functions as a power control unit together with the switching elements 1812 and 1813, and controls the switching elements 1812 and 1813 with control signals (CS181 and CS182) and supplies, to the halogen lamp heaters 186 and 187, drive voltage of selected half-waves of the AC waveform output from the AC power supply 1811.

The temperature detection unit 185 is a temperature detection element, such as a temperature sensor, and disposed near the fixing roller 183, and detects and outputs the temperature of the fixing roller 183 to the control unit 10.

A zero-crossing detection unit 1814 takes in the output of the AC power supply 1811, and generates and outputs a zero-crossing signal ZC181 to the control unit 10.

[3. Explanation of Selection of Half-waves of AC Waveform]

Figure 6:
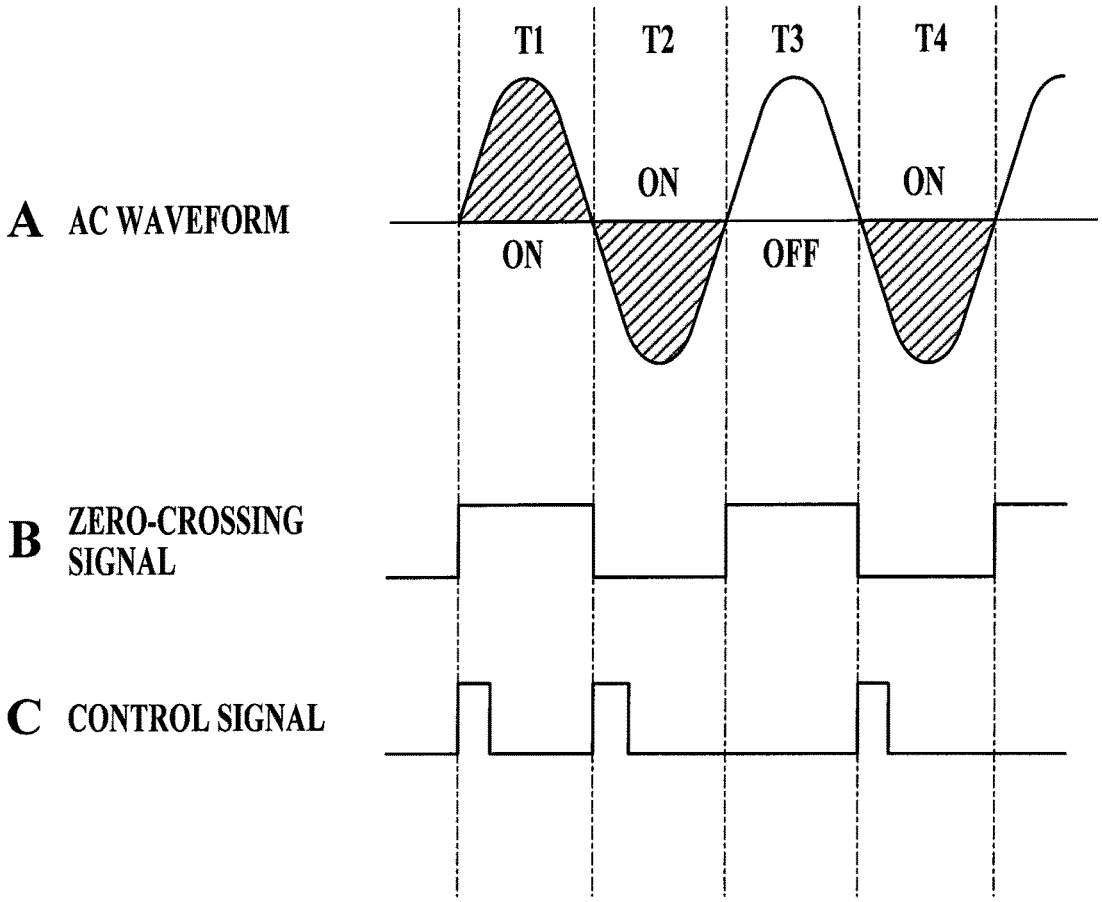
FIG. 6 is an explanatory view showing an example of selecting operation of half-waves of AC waveform.

Herein, with reference to FIG. 6, described is a method of supplying, to the halogen lamp heaters 186 and 187, drive voltage of selected half-waves of the AC waveform output from the AC power supply 1811 using the switching elements 1812 and 1813.

As shown in B portion of FIG. 6, the zero-crossing detection unit 1814 detects each point at which the AC waveform output from the AC power supply 1811 passes through ±0 V, and generates and outputs to the control unit 10 the zero-crossing signal ZC181 of an output value which is changed (from/to positive to/from negative) when the point is detected.

As shown in C portion of FIG. 6, the control unit 10 generates and applies the control signal CS181 (or control signal CS182) synchronized with the input zero-crossing signal ZC181 to the control terminal of the switching element 1812 (or switching element 1813).

That is, as shown in FIG. 6, in each of times T1, T2 and T4 in which the control signal CS181 (or control signal CS182) is applied from the control unit 10 to the switching element 1812 (or switching element 1813), the switching element 1812 (or switching element 1813) becomes "ON" and conducts electricity (conduction state), so that in each of the times T1, T2 and T4, the half-wave of the AC waveform output from the AC power supply 1811 is selected (picked) and supplied to the halogen lamp heater 186 (or halogen lamp heater 187).

On the other hand, in a time T3 in which the control signal CS181 (or control signal CS182) is not applied from the control unit 10 to the switching element 1812 (or switching element 1813), the switching element 1812 (or switching element 1813) stays "OFF" and keeps not conducting electricity (non-conduction state), so that in the time T3, the half-wave of the AC waveform output from the AC power supply 1811 is not selected.

The switching element 1812 (or switching element 1813) keeps the conduction state once the trigger signal (control signal) is applied to the gate thereof, but returns to the non-conduction state when, as the AC waveform, the voltage becomes 0 V. Hence, even when the switching element 1812 (or switching element 1813) takes the conduction state in the time T2, it automatically returns to the non-conduction state in the time T3.

[4. Explanation of Operation of Image Forming Apparatus]

Figure 7:
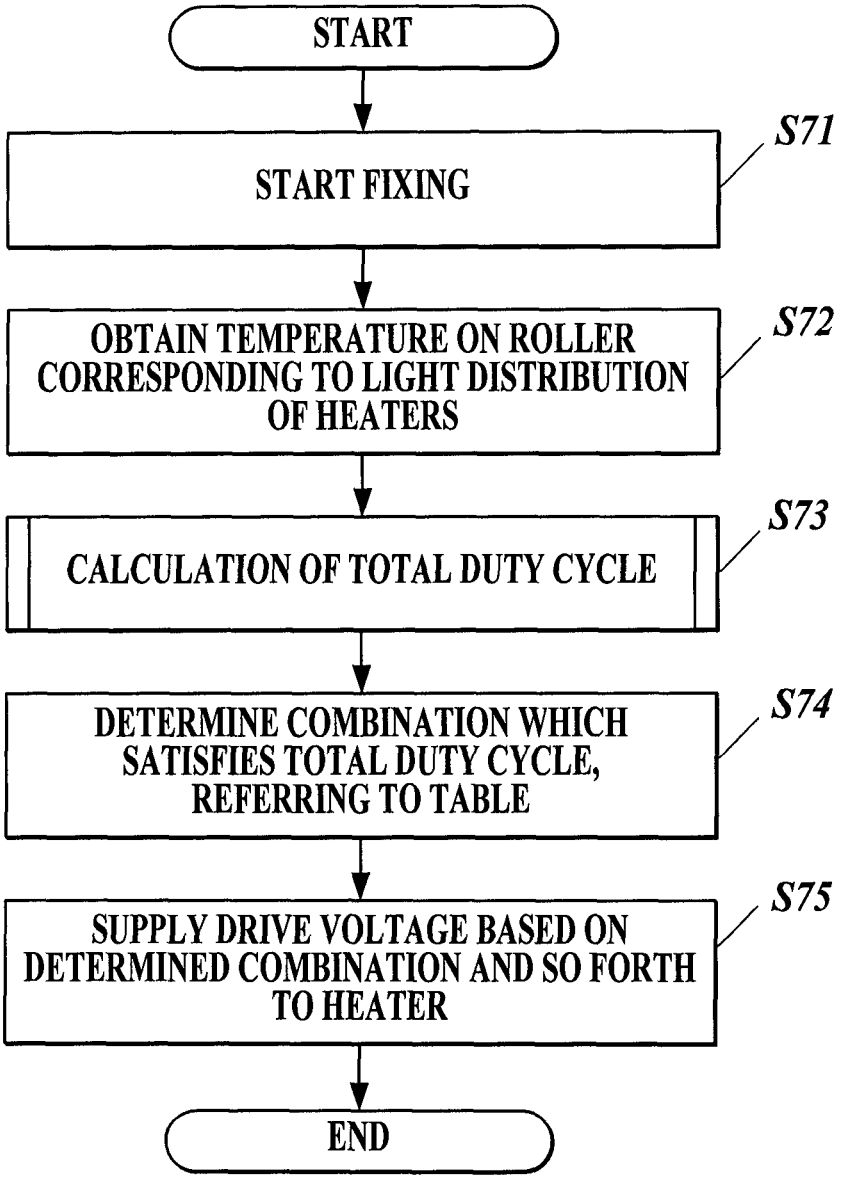
FIG. 7 is a flowchart showing an example of operation of the image forming apparatus.
Figure 8:
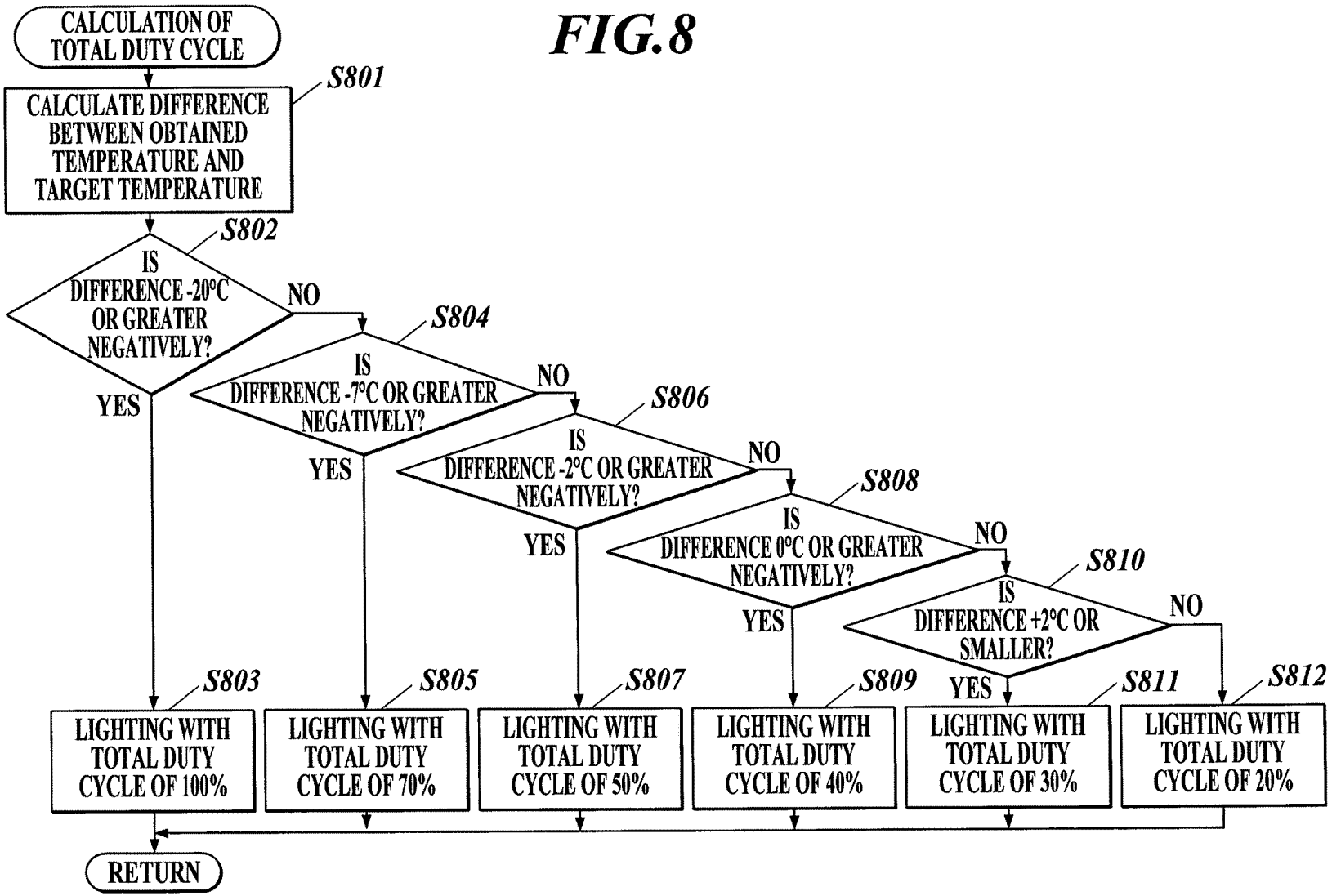
FIG. 8 is a flowchart showing an example of operation of the image forming apparatus.

Herein, operation of the image forming apparatus 1 is described, using flowcharts shown in FIG. 7 and FIG. 8.

In FIG. 7 and FIG. 8, it is assumed that the lower limit of the duty cycle of the application pattern to generate the heat amount required to prevent chemical attack on the halogen lamp heaters 186 and 187 (breaking of the filaments 186*b* and 187*b*) is 40% as an example.

Further, it is assumed that in the image forming apparatus 1, the maximum heat amount required for fixing is 1800 W and the minimum heat amount required for fixing is 300 W (obtained by actual measurement or the like) as an example.

A halogen lamp heater of 750 W (750 W×40%=300 W) or less can handle the minimum heat amount required for fixing. Hence, the operation is described with two halogen lamp heaters 186 and 187 of the same light distribution (middle-portion light distribution) respectively having the maximum heat amounts of 700 W and 1100 W (the sum of the maximum heat amounts is 1800 W).

Similar, if not the same, operation to that shown in FIG. 7 and FIG. 8 can be performed as long as a plurality of halogen lamp heaters of the same light distribution is provided. Hence, the operation can also be performed with a plurality of halogen lamp heaters of the whole-area light distribution or a plurality of halogen lamp heaters of the end-portion light distribution.

The control unit 10 starts fixing (Step S71), and obtains the temperature of a portion of the fixing roller 183, the portion corresponding to the light distribution (e.g., middle-portion light distribution) of the halogen lamp heaters 186 and 187 (Step S72).

Then, the control unit 10 calculates a heat amount (called "total duty cycle" herein) to be output by the two halogen lamp heaters 186 and 187 (Step S73).

More specifically, as shown in FIG. 8, the control unit 10 calculates the difference between the obtained temperature of the fixing roller 183 and a target temperature (Step S801) and determines whether the calculated difference is −20° C. or greater negatively (Step S802).

When determining that the calculated difference is −20° C. or greater negatively (Step S802; YES), the control unit 10 allows lighting with a total duty cycle of 100% (the heat amount to be output by the two halogen lamp heaters 186 and 187 is 1800 W) (Step S803).

On the other hand, when determining that the calculated difference is not −20° C. or greater negatively (Step S802; NO), the control unit 10 determines whether the calculated difference is −7° C. or greater negatively (Step S804). When determining that the calculated difference is −7° C. or greater negatively (Step S804; YES), the control unit 10 allows lighting with a total duty cycle of 70% (the heat amount to be output by the two halogen lamp heaters 186 and 187 is 1260 W) (Step S805).

On the other hand, when determining that the calculated difference is not −7° C. or greater negatively (Step S804; NO), the control unit 10 determines whether the calculated difference is −2° C. or greater negatively (Step S806). When determining that the calculated difference is −2° C. or greater negatively (Step S806; YES), the control unit 10 allows lighting with a total duty cycle of 50% (the heat amount to be output by the two halogen lamp heaters 186 and 187 is 900 W) (Step S807).

On the other hand, when determining that the calculated difference is not −2° C. or greater negatively (Step S806; NO), the control unit 10 determines whether the calculated difference is 0° C. or greater negatively (Step S808). When determining that the calculated difference is 0° C. or greater negatively (Step S808; YES), the control unit 10 allows lighting with a total duty cycle of 40% (the heat amount to be output by the two halogen lamp heaters 186 and 187 is 720 W) (Step S809).

On the other hand, when determining that the calculated difference is not 0° C. or greater negatively (Step S808; NO), the control unit 10 determines whether the calculated difference is +2° C. or smaller (Step S810). When determining that the calculated difference is +2° C. or smaller (Step S810; YES), the control unit 10 allows lighting with a total duty cycle of 30% (the heat amount to be output by the two halogen lamp heaters 186 and 187 is 540 W) (Step S811).

Finally, when determining that the calculated difference is not +2° C. or smaller (Step S810; NO), the control unit 10 determines that the calculated difference is (positively) greater than +2° C., and allows lighting with a total duty cycle of 20% (the heat amount to be output by the two halogen lamp heaters 186 and 187 is 360 W) (Step S812).

For calculation of the total duty cycle to be output by the two halogen lamp heaters 186 and 187, the control unit 10 may calculate the total duty cycle with the following calculation formula without using the flowchart shown in FIG. 8.

$$\text{Total Duty Cycle} = Kp \times \text{Difference} + Ki \times \text{Accumulation of Differences}$$

In the above formula, Kp and Ki are constants.

Referring back to FIG. 7, the control unit 10 determines a combination of the halogen lamp heaters and so forth which satisfy the calculated total duty cycle, referring to a table (Step S74), and supplies drive voltage based on the determined combination of the halogen lamp heaters and so forth to the appropriate (determined) halogen lamp heater and thereby controls the same (Step S75).

The "combination of the halogen lamp heaters" herein includes a combination of the two halogen lamp heaters 186 and 187 (i.e., both of them are used) and a selection of either one of the halogen lamp heaters 186 and 187 (i.e., one of them is used).

The table which the control unit 10 refers to at Step S74 is a table in which the combination of the halogen lamp heaters 186 and 187 and the duty cycle of the application pattern are set forth. The table is stored in advance in the ROM 103 of the control unit 10 or the storage unit 11.

For example, as shown in FIG. 9, in the range of the required heat amount being small (from 280 W to 653 W), the 700 W halogen lamp heater 186 is used, and the duty cycle of the application pattern for drive voltage to be supplied thereto is controlled.

For example, as shown in FIG. 9, in the range from more than the maximum heat amount of the halogen lamp heater 186 to the maximum heat amount of the halogen lamp heater 187 (from 733 W to 1100 W), the 1100 W halogen lamp heater 187 is used, and the duty cycle of the application pattern for drive voltage to be supplied thereto is controlled.

For example, as shown in FIG. 9, in the range exceeding the maximum heat amount of the halogen lamp heater 187 (from 1140 W to 1800 W), the 700 W halogen lamp heater 186 is fully turned on (i.e., controlled with a duty cycle of 100%), and also the 1100 W halogen lamp heater 187 is used, and the duty cycle of the application pattern for drive voltage to be supplied thereto is controlled.

That is, as shown in FIG. 9, 280 W (less than 300 W which is the minimum heat amount required for fixing) to 1800 W (maximum heat amount) can be generated with predetermined resolutions. This can eliminate the need to turn off a halogen lamp heater(s) at appropriate timing to make the heat amount close to the required heat amount, and can stabilize the temperature of a fixing roller.

The application pattern for drive voltage to be supplied to the halogen lamp heaters 186 and 187 is an application pattern to appropriately select half-wave(s) of the AC waveform from among, for example, 15 half-waves as one period.

Hence, as shown in FIG. 9, the resolution of the 700 W halogen lamp heater 186 is as follows.

700 W/15 half-waves=about 47 W

Further, the resolution of the 1100 W halogen lamp heater 187 is as follows.

1100 W/15 half-waves=about 73 W

Resolutions of the points at which the combination of the halogen lamp heaters is switched from one to another are 80 W and 40 W.

The number of half-waves in one period in the application pattern, from which (a) half-waves can be selected, is not limited to 15 as a matter of course.

In the table shown in FIG. 9, the lowest duty cycle of the application pattern for drive voltage to be supplied to the halogen lamp heaters 186 and 187 is 40%. This can generate the heat amount required to prevent chemical attack (breaking of the filaments 186*b* and 187*b*).

For example, when the calculated difference is 0° C., the total duty cycle is 40% (720 W, which is between 653 W and 733 W) according to the flowchart shown in FIG. 8. Hence, the control unit 10 selects a combination of the halogen lamp heaters and a duty cycle of the application pattern which generate a heat amount of 733 W, referring to the table shown in FIG. 9.

That is, the 1100 W halogen lamp heater 187 is used, and drive voltage is supplied to the halogen lamp heater 187 with the application pattern having a duty cycle of 66%, which generates a heat amount of 733 W and thereby controls the temperature of the fixing roller 183.

The table shown in FIG. 9 is based on the assumption of combination of the 700 W halogen lamp heater 186 and the 1100 W halogen lamp heater 187. Needless to say, however, as long as at least one halogen lamp heater is a 750 W or less halogen lamp heater, the minimum heat amount required for fixing can be handled. Hence, for example, combination of a 600 W halogen lamp heater and a 1200 W halogen lamp heater or combination of a 500 W halogen lamp heater and a 1300 W halogen lamp heater can also be used.

For example, as shown in the table shown in FIG. 10, combination of a 600 W halogen lamp heater and a 1200 W halogen lamp heater of the same light distribution can generate 240 W (minimum heat amount) to 1800 W (maximum heat amount) with resolutions of about 40 W, 80 W and 120 W without the duty cycle being less than a predetermined value (predetermined duty cycle) (e.g., 40%) with which the heat amount required to prevent chemical attack (breaking of filaments) can be generated.

For example, as shown in the table shown in FIG. 11, combination of a 500 W halogen lamp heater and a 1300 W halogen lamp heater of the same light distribution can generate 200 W (minimum heat amount) to 1800 W (maximum heat amount) with resolutions of about 33 W, 67 W, 87 W and 107 W without the duty cycle being less than a predetermined value (predetermined duty cycle) (e.g., 40%) with which the heat amount required to prevent chemical attack (breaking of filaments) can be generated.

As described above, the control unit 10 combines two halogen lamp heaters having the same light distribution based on output of the temperature detection unit 185, and applies drive voltage of half-wave (s) of the AC waveform of the AC power supply to a halogen lamp heater of the halogen lamp heaters, the half-wave(s) being appropriately selected based on an application pattern having a duty cycle of a predetermined value or more. This can generate the heat amount required to prevent chemical attack (breaking of the filaments 186*b* and 187*b*) and can extend the lives of the halogen lamp heaters.

Further, the halogen lamp heaters include at least one halogen lamp heater which generates a heat amount being the minimum heat amount required for fixing or less when turned on with the application pattern having the duty cycle of the predetermined value. This can generate heat amounts ranging from the minimum heat amount to the maximum heat amount required for fixing, and can stabilize the temperature of the fixing roller 183.

(Modification)

The embodiment is based on the assumption of combination of two halogen lamp heaters of the same light distribution. Alternatively, combination of more than two halogen lamp heaters may be used.

For example, as shown in the table shown in FIG. 12, combination of three 600 W halogen lamp heaters of the same light distribution can generate 240 W (minimum heat amount) to 1800 W (maximum heat amount) with resolutions of about 40 W and 240 W without the duty cycle being less than a predetermined value (predetermined duty cycle) (e.g., 40%) with which the heat amount required to prevent chemical attack (breaking of filaments) can be generated.

However, because three halogen lamp heaters of the same light distribution are used, in the range from 240 W to 600 W, one of the three halogen lamp heaters is used, and the duty cycle of the application pattern for drive voltage to be supplied thereto is controlled.

In the range from 840 W to 1200 W, one of the three halogen lamp heaters is fully turned on (i.e., controlled with a duty cycle of 100%), and also another one thereof is used, and the duty cycle of the application pattern for drive voltage to be supplied thereto is controlled.

In the range from 1440 W to 1800 W, two of the three halogen lamp heaters are fully turned on (i.e., each controlled with a duty cycle of 100%), and also the other one is used, and the duty cycle of the application pattern for drive voltage to be supplied thereto is controlled.

As described above, according to the modification, combination of three halogen lamp heaters having the same light distribution can generate the heat amount required to prevent chemical attack (breaking of the filaments 186*b* and 187*b*) and can extend the lives of the halogen lamp heaters.

Further, the halogen lamp heaters include at least one halogen lamp heater which generates a heat amount being the minimum heat amount required for fixing or less when turned on with the application pattern having the duty cycle of the predetermined value. This can generate heat amounts ranging from the minimum heat amount to the maximum heat amount required for fixing, and can stabilize the temperature of the fixing roller 183.

In the above embodiment or the like, it is assumed that the minimum heat amount and the maximum heat amount required for fixing are 300 W and 1800 W, respectively, but not limited thereto as a matter of course. These values depend on the size, capacity and so forth of an image forming apparatus.

Further, in the above embodiment or the like, the predetermined duty cycle to generate the heat amount required to prevent chemical attack (breaking of filaments) is 40%, but not limited thereto as a matter of course. The predetermined duty cycle is different for each halogen lamp heater and changes depending on, for example, the concentration of the halogen gas with which the halogen lamp heater is filled.

Further, in the above embodiment or the like, the fixing roller 183 and the pressure roller 184 of the image fixing unit 18 form the fixing nip to sandwich and convey paper P. Alternatively, the image fixing unit 18 may include a heating roller as a heating member and a fixing belt stretched around the heating roller and the fixing roller 183, and the fixing roller 183 and the pressure roller 184 may form the fixing nip to sandwich and convey paper P via the fixing belt.

Further, in the above embodiment or the like, the image forming apparatus 1 includes the image forming sections for the respective colors of Y (yellow), M (magenta), C (cyan) and K (black), and forms multi-color images on paper P. The image forming apparatus 1 is not limited thereto and may be an image forming apparatus which forms monochrome images.

Further, in the above embodiment or the like, the fixing roller and the pressure roller are separately described, but may be regarded as a pair of fixing members.

Further, in the above embodiment or the like, paper is used as the recording medium. The recording medium is not limited to paper and may be any as long as it is in the shape of a sheet and can have toner images formed and fixed there. Examples thereof include nonwoven fabric, plastic films and leather.

What is claimed is:

1. An apparatus comprising:

a plurality of halogen lamp heaters which heat a fixing member of an image fixing unit;

an AC power supply;

a temperature detection unit which detects a temperature of the fixing member; and a control unit which determines a combination of the halogen lamp heaters based on output of the temperature detection unit, and applies a drive voltage of a half-wave of an AC waveform of the AC power supply to a halogen lamp heater of the halogen lamp heaters, the half-wave being selected based on an application pattern having a duty cycle of a predetermined value or more, wherein the halogen lamp heaters include at least one halogen lamp heater which generates a heat amount being a minimum heat amount required for fixing or less when turned on with the application pattern having the duty cycle of the minimum value that can prevent chemical attack.

2. The image forming apparatus according to claim 1, further comprising a table in which the combination of the halogen lamp heaters and the duty cycle of the minimum value that can prevent chemical attack or more are set forth, wherein the control unit calculates a required heat amount based on the output of the temperature detection unit, and selects the combination of the halogen lamp heaters and the duty cycle which satisfy the required heat amount.

3. The image forming apparatus according to claim 1, wherein the control unit applies the drive voltage to one of the halogen lamp heaters and fully turns on a rest of the halogen lamp heaters.

4. The image forming apparatus according to claim 1, wherein the halogen lamp heaters include: a first halogen lamp heater; and a second halogen lamp heater which generates a less heat amount than the first halogen lamp heater, and the second halogen lamp heater generates a heat amount being the minimum heat amount required for fixing or less when turned on with the application pattern having the duty cycle of the minimum value that can prevent chemical attack.

5. The image forming apparatus according to claim 1, wherein the halogen lamp heaters include: a first halogen lamp heater; and a second halogen lamp heater which generates a less heat amount than the first halogen lamp heater, and the control unit applies the drive voltage to the second halogen lamp heater when a heat amount required for fixing is equal to or less than the heat amount of the second halogen lamp heater.

6. The image forming apparatus according to claim 1, wherein the halogen lamp heaters include: a first halogen lamp heater; and a second halogen lamp heater which generates a less heat amount than the first halogen lamp heater, and the control unit applies the drive voltage to the first halogen lamp heater when a heat amount required for fixing is more than the heat amount of the second halogen lamp heater and equal to or less than a heat amount of the first halogen lamp heater.

7. The image forming apparatus according to claim 1, wherein the halogen lamp heaters include: a first halogen lamp heater; and a second halogen lamp heater which generates a less heat amount than the first halogen lamp heater, and the control unit applies the drive voltage to the first halogen lamp heater and fully turns on the second halogen lamp heater when a heat amount required for fixing is more than a heat amount of the first halogen lamp heater.

8. The image forming apparatus according to claim 1, wherein a heat amount generated by any of the halogen lamp heaters turned on with the application pattern having the duty cycle of the minimum value that can prevent chemical attack is a heat amount required to prevent breaking of a filament of any of the halogen lamp heaters.

* * * * *